US010900263B2

(12) United States Patent
Laliberte et al.

(10) Patent No.: US 10,900,263 B2
(45) Date of Patent: Jan. 26, 2021

(54) RETRACTABLE LATCH HOOK SHROUD ASSEMBLY

(71) Applicant: STANLEY BLACK & DECKER, INC., New Britain, CT (US)

(72) Inventors: Ronald Laliberte, Farmington, CT (US); Vinay N. Patel, Berlin, CT (US); Seth Strauser, Farmington, CT (US); James Cavanaugh, Farmington, CT (US)

(73) Assignee: Stanley Black & Decker Inc., New Britain, CT (US)

( * ) Notice: Subject to any disclaimer, the term of this patent is extended or adjusted under 35 U.S.C. 154(b) by 305 days.

(21) Appl. No.: 15/953,848

(22) Filed: Apr. 16, 2018

(65) Prior Publication Data

US 2018/0298656 A1 Oct. 18, 2018

Related U.S. Application Data

(60) Provisional application No. 62/486,310, filed on Apr. 17, 2017.

(51) Int. Cl.

| | |
|---|---|
| ***E05C 21/00*** | (2006.01) |
| ***E05C 3/00*** | (2006.01) |
| ***E05B 65/08*** | (2006.01) |
| ***E05C 5/00*** | (2006.01) |
| *E06B 3/46* | (2006.01) |
| *E05B 17/00* | (2006.01) |

(52) U.S. Cl.

CPC ..... *E05C 21/00* (2013.01); *E05B 65/0811* (2013.01); *E05C 3/004* (2013.01); *E05C 5/00* (2013.01); *E05B 2017/0095* (2013.01); *E06B 3/4636* (2013.01)

(58) Field of Classification Search

CPC ... Y10T 292/62; Y10T 292/79; Y10T 292/03; Y10T 70/7921; Y10T 292/18; Y10T 70/493; Y10T 70/7915; Y10T 70/7927; Y10T 70/8568; E05B 17/2003; E05B 13/001; E05B 17/2084; E05B 2017/2096; E05B 9/00; Y10S 292/02

See application file for complete search history.

(56) References Cited

U.S. PATENT DOCUMENTS 1,332,874 A * 3/1920 Adams ..... E05C 1/10 292/175

2,194,408 A * 3/1940 Sluss ..... A01K 1/0017 292/136

(Continued)

*Primary Examiner* — Mark A Williams

(74) *Attorney, Agent, or Firm* — Caeden Drayton; Adan Ayala

(57) ABSTRACT

A retractable latch hook shroud assembly includes a base plate, a first post, a second post, a shroud, and a spring biasing mechanism. The first post extends from the base plate in a first direction. The second post extends from the base plate in the first direction, and the second post is spaced away from the first post in a direction orthogonal to the first direction. A shroud has an end wall and a side wall that extends away from the end wall. The side wall defines a latch hook recess. The end wall has a first hole and a second hole. The first hole is configured to slidably receive the first post and the second hole is configured to slidably receive the second post. The spring biasing mechanism is interposed between the base plate and the end wall of the shroud.

6 Claims, 6 Drawing Sheets

(56) References Cited

U.S. PATENT DOCUMENTS

| | | | | |
|---|---|---|---|---|
| 4,160,560 | A * | 7/1979 | Hauber | E05B 65/0811 292/101 |
| 6,679,533 | B1 * | 1/2004 | Bruner | E05B 15/0205 292/346 |
| 6,931,897 | B2 * | 8/2005 | Talpe | E05B 65/0841 292/215 |
| 8,186,189 | B2 * | 5/2012 | Brisco | E05B 5/00 292/337 |
| 2006/0082166 | A1 * | 4/2006 | Lawrence | E05B 15/10 292/337 |
| 2009/0096220 | A1 * | 4/2009 | Lutfallah | E05C 17/60 292/2 |
| 2009/0282745 | A1 * | 11/2009 | Franschman | E06B 1/52 49/504 |
| 2011/0163555 | A1 * | 7/2011 | Watts | E05B 1/0038 292/336.3 |
| 2019/0309538 | A1 * | 10/2019 | Patel | E05B 7/00 |
| 2020/0141158 | A1 * | 5/2020 | Kenny | E05B 63/042 |

* cited by examiner

RETRACTABLE LATCH HOOK SHROUD ASSEMBLY

CROSS-REFERENCE TO RELATED APPLICATIONS

This application claims priority to U.S. provisional patent application Ser. No. 62/486,310 entitled "RETRACTABLE LATCH HOOK SHROUD" filed Apr. 17, 2017, which is incorporated herein by reference. This application is related to PCT application No. PCT/US2017/065357, entitled "DOOR SYSTEM HAVING A SWING INTERLOCK SYSTEM", filed Dec. 8, 2017, and PCT application No. PCT/US2017/065567, entitled "SLIDE LATCHING SYSTEM FOR A DOOR SYSTEM", filed Dec. 11, 2017.

TECHNICAL FIELD

The present invention relates to a door, and, more particularly, to a retractable latch hook shroud assembly for use with a door.

BACKGROUND ART

Entry doors for hospital ICU/CCU rooms are typically equipped with a door panel which has the ability to both slide closed, and under emergency circumstances or for convenience, swing open to provide greater access to the ICU/CCU room. Previously, the ICU/CCU rooms were equipped with manual sliding doors that provided for full access into or out of the room through the breakaway provision of the sliding door.

Such a sliding door panel typically includes a latch assembly having a latch hook that protrudes from the door panel end that faces a door jamb, so as to engage the door jamb when the door panel is closed, and to hold the door panel closed. The door panel will include an operator handle coupled to the latch assembly to lift the latch hook, so that the door panel may be opened. However, since the latch hook continually protrudes from the door panel end, when the door panel is opened the latch hook is exposed, which presents the possibility of snagging on the equipment or clothing that passes through the door opening.

What is needed in the art is a retractable latch hook shroud assembly, for use with the door panel, which does not interfere with the closing of the door panel, but which provides a covering over the latch hook that protrudes from the door panel end when the door panel is open, such that the latch hook is enclosed when the door panel is open.

SUMMARY OF INVENTION

The present invention provides a retractable latch hook shroud assembly, for use with a door panel, which has a shroud that encloses, i.e., surrounds, the latch hook of a door latch assembly when the door panel is open to help prevent snagging of clothing and equipment, e.g., hospital garments, IV lines, etc., as personnel and equipment pass through the door opening.

The invention, in one form, is directed to a retractable latch hook shroud assembly having a spring-loaded and retractable shroud, so that as the door panel closes fully, the shroud retracts to allow the latch hook to engage the associated door jamb. Upon opening of the door panel, the shroud extends to enclose, i.e., surround, the latch hook by virtue of the spring loading.

The retractable latch hook shroud assembly may include a base plate, a first post, a second post, a shroud, and a spring biasing mechanism. The first post extends from the base plate in a first direction. The second post extends from the base plate in the first direction, and the second post is spaced away from the first post in a direction orthogonal to the first direction. The shroud has an end wall and a side wall that extends away from the end wall. The side wall defines a latch hook recess. The end wall has a first hole and a second hole. The first hole is configured to slidably receive the first post and the second hole is configured to slidably receive the second post. The spring biasing mechanism is interposed between the base plate and the end wall of the shroud.

The invention, in another form, is directed to a door system that includes a door frame, a door panel, a latch assembly, and a retractable latch hook shroud assembly. The door frame has a door jamb, and the door jamb has a jamb strike. The door panel is slidably coupled to the door frame. The door panel has a closed position and an open position. The door panel has a door panel end that faces the door jamb and an end portion adjacent the door panel end. The latch assembly has a latch hook that protrudes from the door panel end to engage the jamb strike of the door jamb when the door panel is in a closed position. The retractable latch hook shroud assembly is connected to an end portion of the door panel. The retractable latch hook shroud assembly includes a shroud that is movable between a retracted position and an extended position. In the extended position, the shroud protrudes from the door panel end to enclose the latch hook. As the door panel is moved toward the closed position, the shroud engages the door jamb and is moved toward the retracted position.

An advantage of the present invention is that as the door panel is opened, the shroud of the latch hook shroud assembly extends to enclose, i.e., surround, the latch hook by virtue of the spring loading, so as to help prevent snagging of clothing and equipment, e.g., hospital garments, IV lines, etc., as personnel and/or equipment pass through the door opening.

Given the following enabling description of the drawings, the invention should become evident to a person of ordinary skill in the art.

BRIEF DESCRIPTION OF DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate an embodiment of the invention, and such exemplifications are not to be construed as limiting the scope of the invention in any manner.

DESCRIPTION OF EMBODIMENTS

Figure 1:
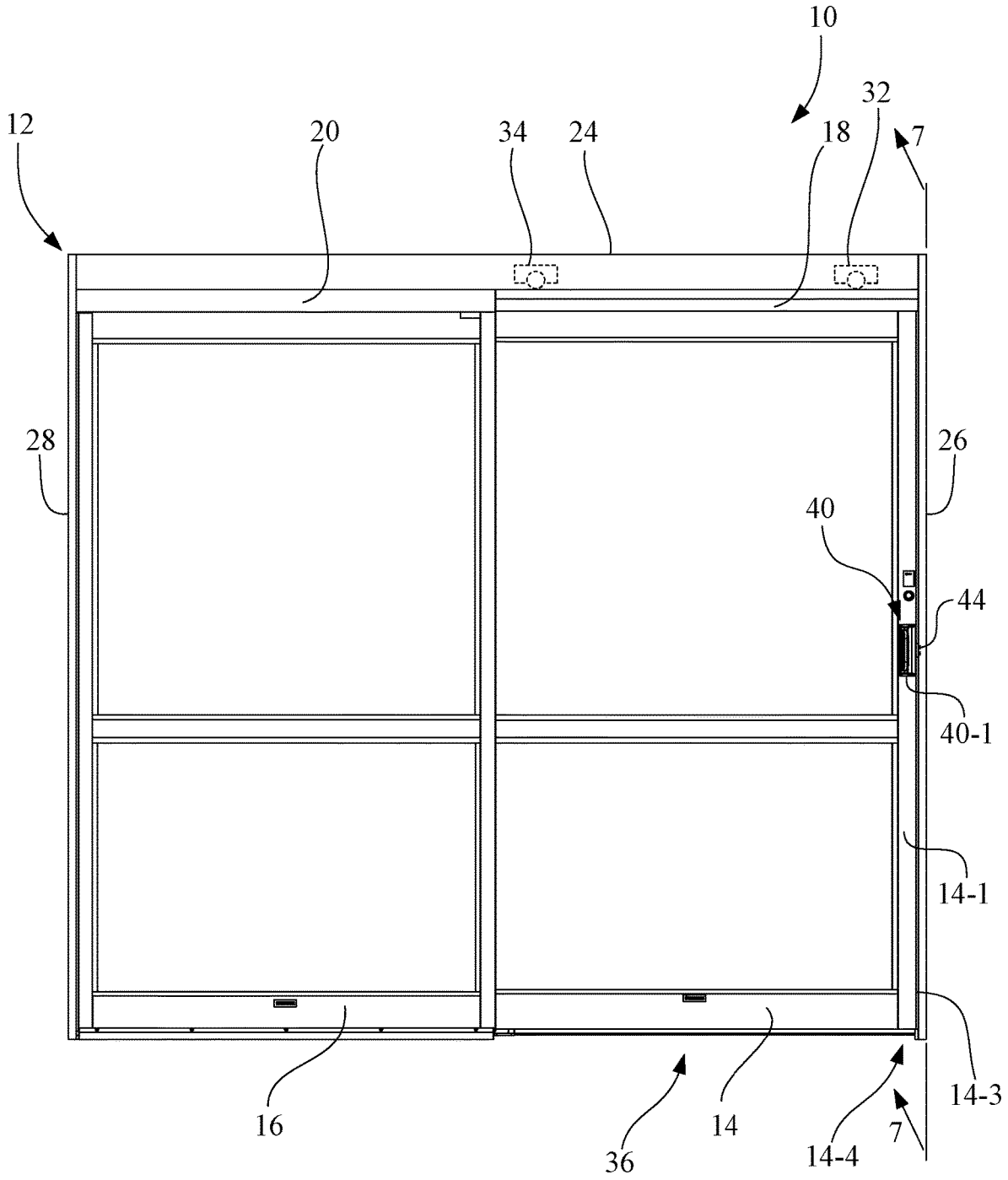
FIG. 1 is an exterior side view of a door system having a slidable door panel, with the sliding door panel in the closed position.

Referring now to the drawings, and more particularly to FIG. 1, there is illustrated a door system 10 having a door frame 12, a door panel 14, a door panel 16, a panel hanger member 18, and a panel hanger member 20. Door system 10 incorporating door panel 14 and door panel 16 provides visibility access into and out of a room.

In the present embodiment, one door panel, i.e., door panel 14, is telescopic, i.e., slidable, to allow a greater clear door opening for a given rough opening, thereby providing flexible access to overall and individual patient areas. Door panel 16 may be coupled to door frame 12 in a manner to prohibit sliding motion. Door system 10 may include trackless threshold features, thereby minimizing access obstacles. Door system 10 may be further configured such that door panel 14 and door panel 16 may be allowed to breakout (i.e., to be swung open) under certain circumstances.

Door frame 12 includes a header member 24, a door jamb 26, and a door jamb 28. Door jamb 28 is spaced from door jamb 26, with header member 24 extending between door jamb 26 and door jamb 28. Door jamb 26, door jamb 28, and header member 24 are interconnected, e.g., by mechanical fasteners, such as screws or bolts, to form an upside down U-shaped structure. Door jamb 26 has a jamb strike 30 (see FIGS. 7-8), and in particular, door jamb 26 includes a recess within which jamb strike 30 extends, and with jamb strike 30 being connected to door jamb 26. Jamb strike 30 includes a strike catch 30-1.

Door panel 16 is located to be adjacent door jamb 28, and may be connected to door frame 12 via panel hanger member 20 in a manner such that door panel 16 is prevented from sliding movement relative to door frame 12 in all circumstances, however door panel 16 is not limited in this regard and can be detachably connected to door frame 12 for slidable or swing movement of the door panel 16.

Panel hanger member 18 is slidably coupled to header member 24 via at least two roller assemblies 32, 34, as is known in the art. Door panel 14 and door panel 16 are positioned within door frame 12 and staggered in a telescoping manner.

Door panel 14 has an exterior side 14-1, an interior side 14-2 (see FIG. 2), a door panel end 14-3, and a handle end portion 14-4 that is adjacent door panel end 14-3. Door panel end 14-3 faces door jamb 26. Door panel 14 is connected to panel hanger member 18, e, g., by fasteners, such as bolts and/or screws, such that door panel 14 and panel hanger member 18 slide in unison between a closed position 36 (see FIG. 1) and an open position 38 (see FIG. 2). Thus, door panel 14 is slidably coupled to door frame 12. In the closed position 36, door panel 14 is positioned adjacent door jamb 26.

Figure 2:
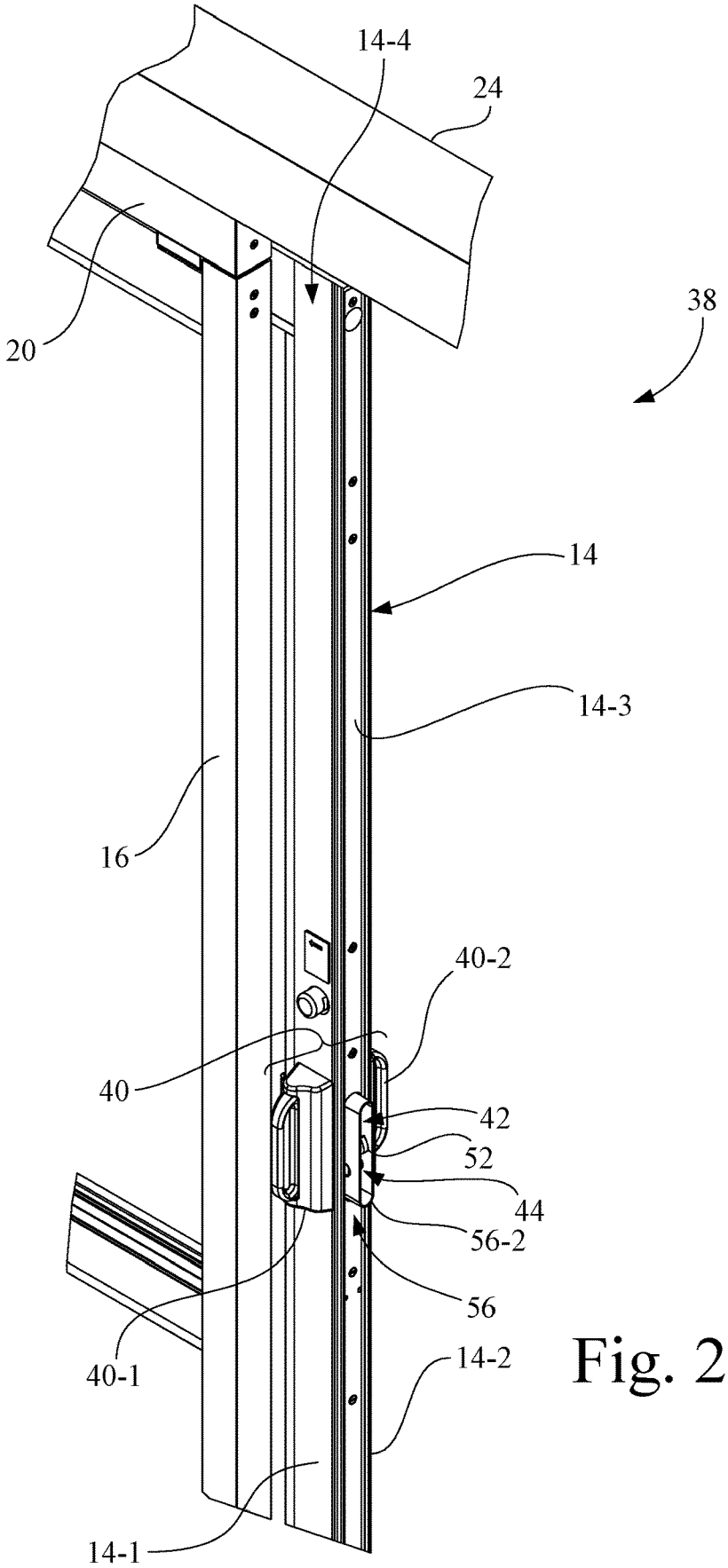
FIG. 2 is an exterior perspective view of a portion of the door system of FIG. 1, with the sliding door panel in an open position.
Figure 3:
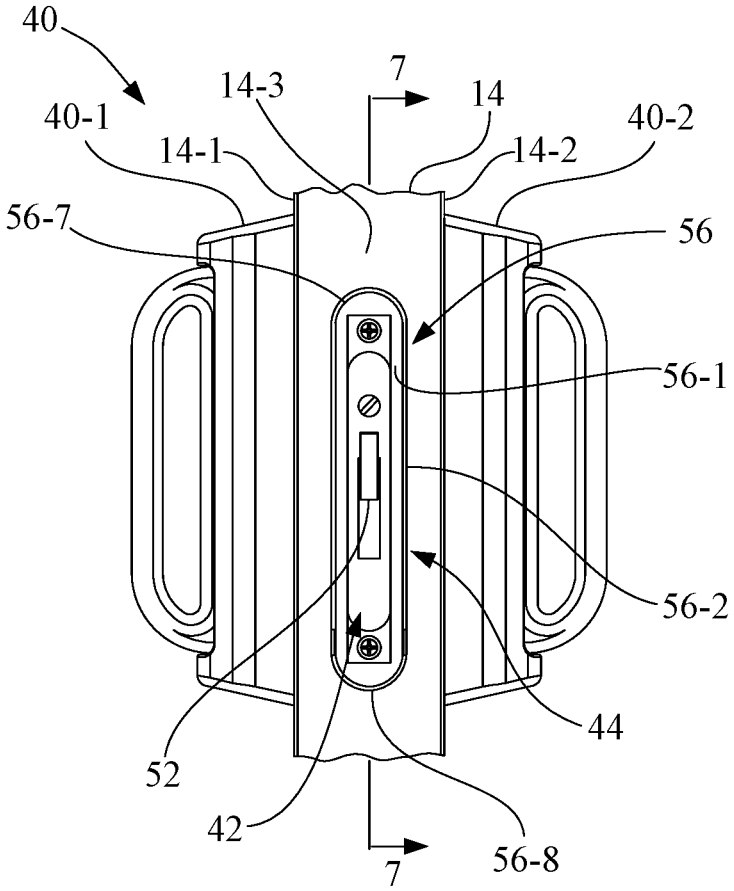
FIG. 3 is an end view of a portion of the sliding door panel of the door system of FIG. 1, showing a retractable latch hook shroud assembly attached to an end portion of the sliding door panel.

Referring particularly to FIGS. 2 and 3, door system 10 further includes a paddle handle assembly 40, a latch assembly 42, and a retractable latch hook shroud assembly 44. Paddle handle assembly 40 may include an exterior handle set 40-1 mounted to exterior side 14-1 of sliding door panel 14 and an interior handle set 40-2 mounted to interior side 14-2 of sliding door panel 14.

Each of latch assembly 42 and retractable latch hook shroud assembly 44 extends into an end recess of door panel 14. Retractable latch hook shroud assembly 44 is connected to door panel 14, and latch assembly 42 is connected to retractable latch hook shroud assembly 44.

Figure 4:
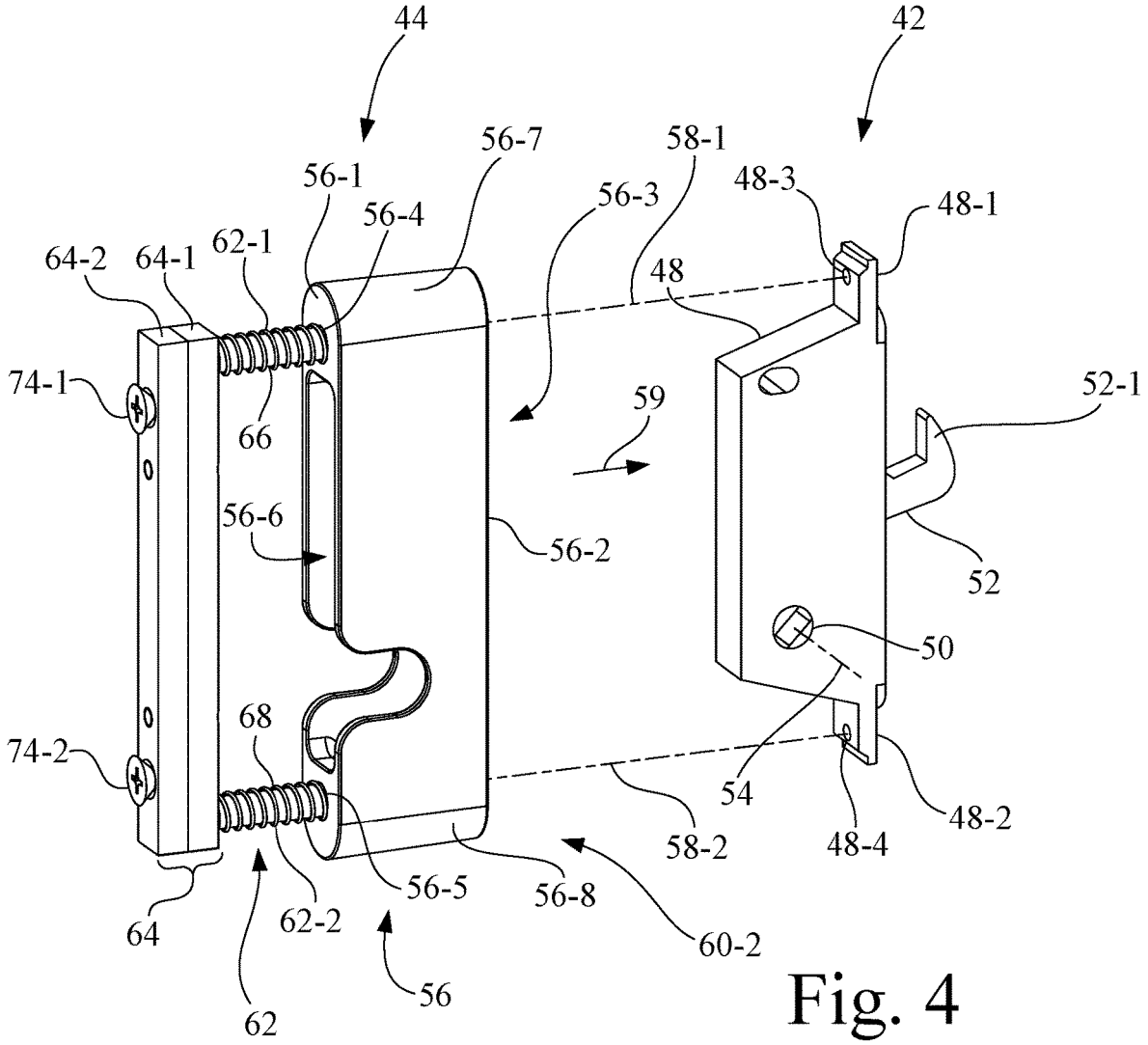
FIG. 4 is an exploded perspective view of the retractable latch hook shroud assembly and latch assembly of a door panel of FIGS. 1-3.

Referring to FIG. 4, latch assembly 42 has a latch housing 48, a rotary actuator 50, and a latch hook 52, as is known in the art. Rotary actuator 50 is operably connected to exterior handle set 40-1 (see FIG. 2) and interior handle set 40-2 of paddle handle assembly 40. Latch hook 52 is drivably coupled to rotary actuator 50 such that latch hook 52 and the rotary actuator 50 pivot about latch pivot axis 54 substantially in unison upon operation of either of exterior handle set 40-1 or interior handle set 40-2 of paddle handle assembly 40.

Figure 8:
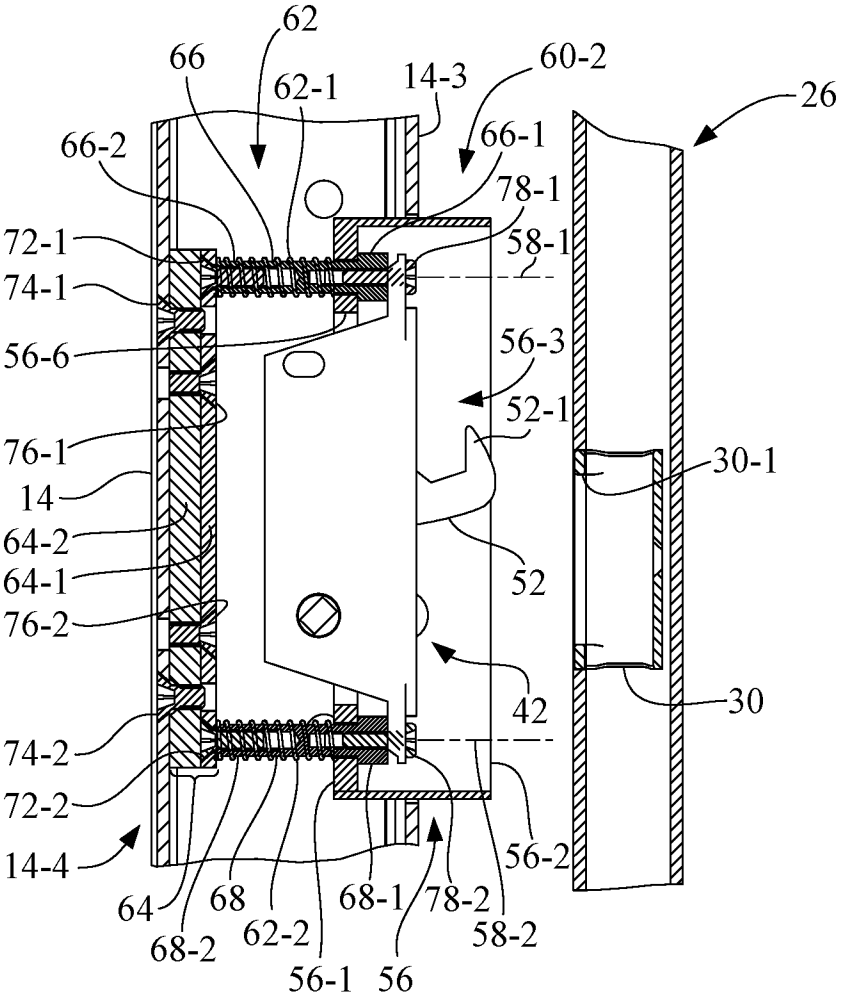
FIG. 8 is a modification of the section view of FIG. 7, showing the door panel moved away from the closed position, and showing the retractable latch hook shroud assembly with the shroud in the extended position.
Figure 7:
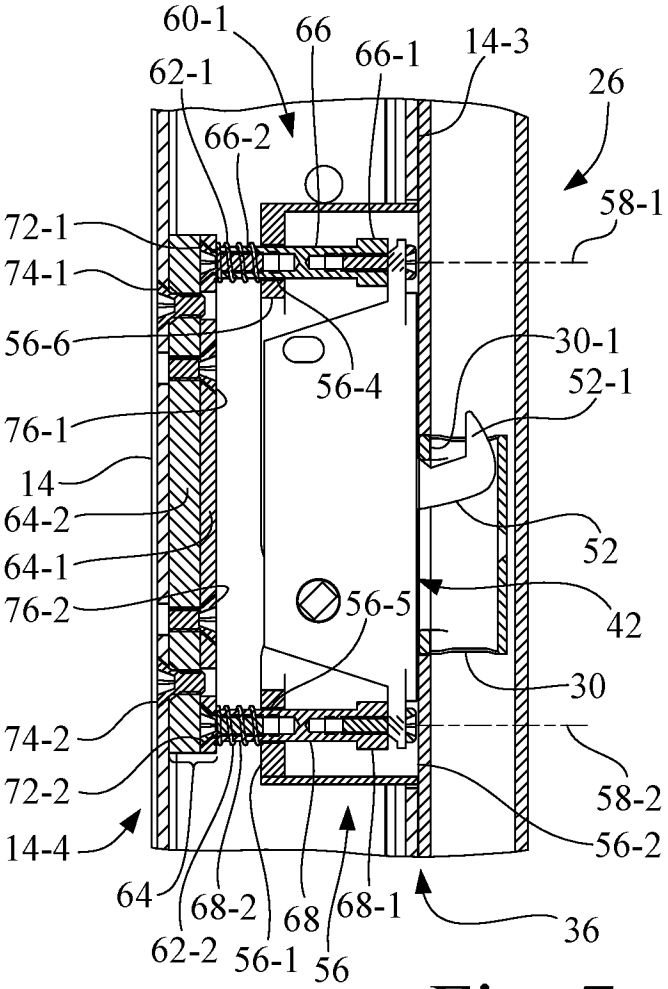
FIG. 7 is a section view of a portion of the door system of FIG. 1, taken along line 7-7 of FIG. 1, with the sliding door panel in the closed position, and showing the retractable latch hook shroud assembly with the shroud in the retracted position.

Referring to FIGS. 2 and 7, latch hook 52 protrudes from door panel end 14-3 to engage jamb strike 30 of door jamb 26 when door panel 14 is closed, i.e., in the closed position 36. Latch hook 52 has an upwardly extending hook 52-1 configured to engage jamb strike 30, and more particularly, to latchably engage strike catch 30-1 of jamb strike 30 when door panel 14 is in the closed position 36. In this embodiment, the latch hook 52 is illustrated as an upwardly extending hook 52-1, but is not limited in this regard and can be any configuration configured for latching, e.g., downwardly or sidewardly. Referring also to FIG. 8, upon operation of either of exterior handle set 40-1 or interior handle set 40-2, latch hook 52 is rotated to disengage the upwardly extending hook 52-1 from strike catch 30-1 of jamb strike 30 to facilitate sliding movement of door panel 14 away from the closed position 36 depicted in FIG. 1.

Figure 5:
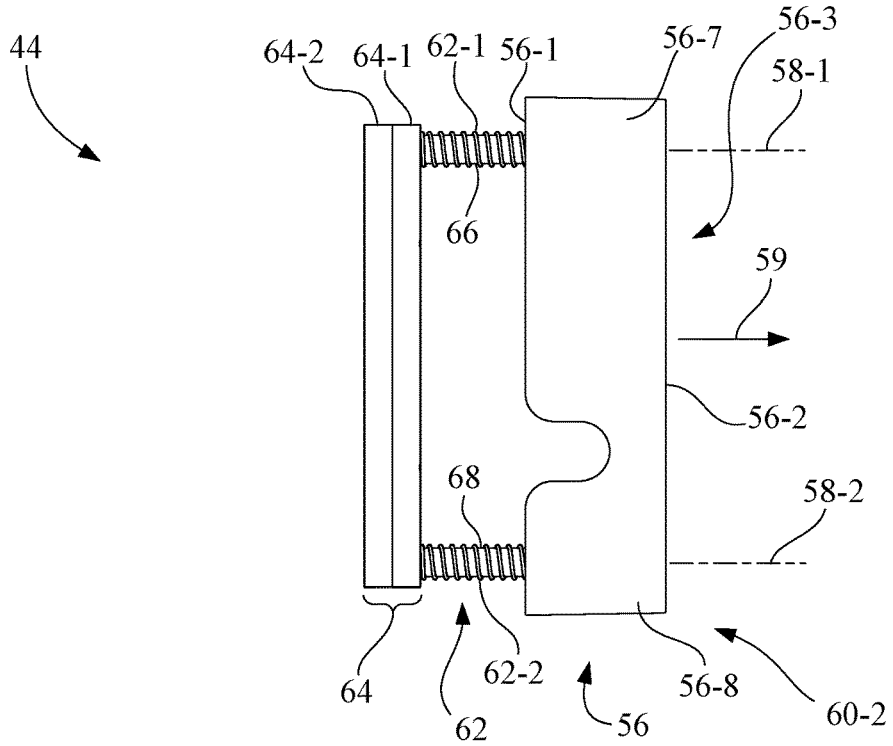
FIG. 5 is a side view of the retractable latch hook shroud assembly of FIG. 4.
Figure 6:
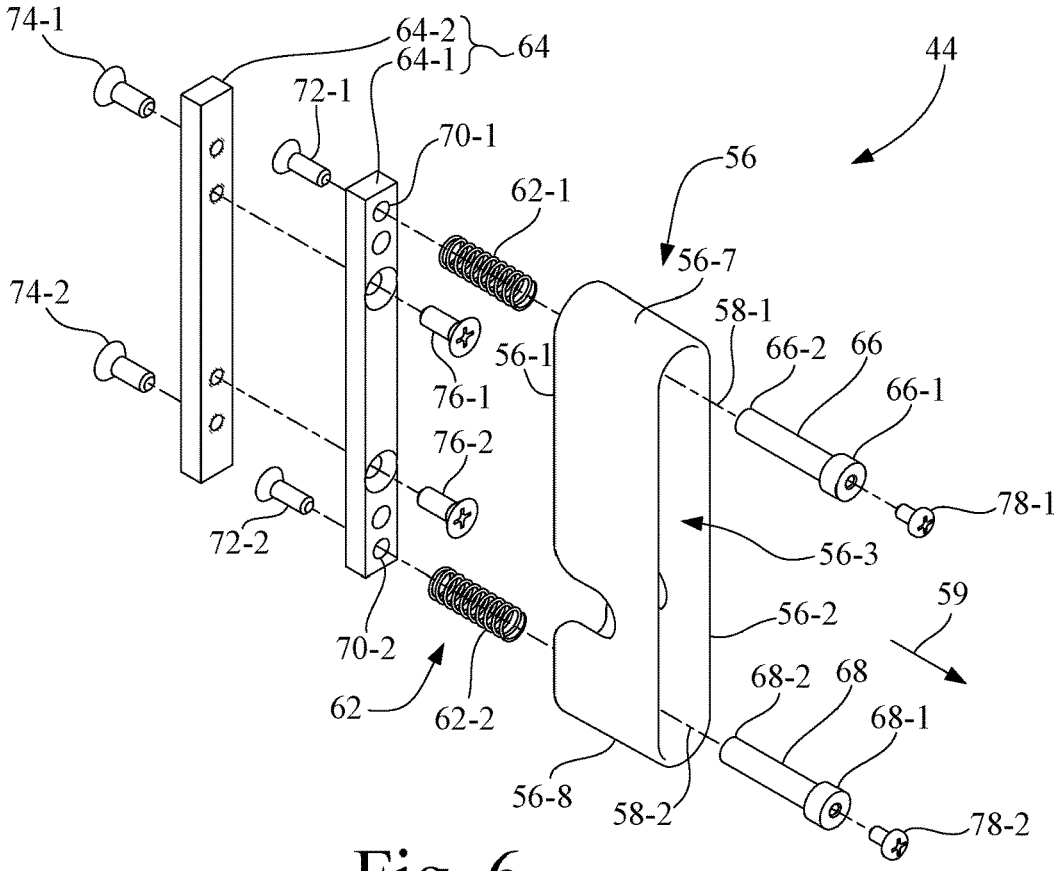
FIG. 6 is an exploded perspective view of the retractable latch hook shroud assembly of FIG. 5.

Referring to FIGS. 7 and 8, retractable latch hook shroud assembly 44 is connected to handle end portion 14-4 of door panel 14. Referring to FIGS. 4-6, retractable latch hook shroud assembly 44 includes a shroud 56 that is movable along movement axes 58-1, 58-2 between a retracted position 60-1 (see FIG. 7) when door panel 14 is in closed position 36 (see also FIG. 1) and an extended position 60-2 (see FIG. 8) when door panel 14 is moved away from closed position 36 toward open position 38 (see also FIG. 2).

Referring to FIG. 8, when shroud 56 is in extended position 60-2, shroud 56 protrudes from door panel end 14-3 to enclose latch hook 52. Shroud 56 reaches its full extent, i.e., extended position 60-2, as shroud 56 is disengaged from door jamb 26 as door panel 14 is opened. As used herein, to "enclose" means that shroud 56 substantially or completely encircle latch hook 52. For example, shroud 56 may protrude from door panel end 14-3 a distance that is substantially equal to, e.g., ±1 centimeter, the distance that latch hook 52 protrudes from door panel end 14-3. As the door panel 14 is moved toward closed position 36, shroud 56 engages door jamb 26 and shroud 56 is moved toward retracted position 60-1 (see FIG. 7).

Referring to FIGS. 4-8, retractable latch hook shroud assembly 44 includes a spring biasing mechanism 62 to bias shroud 56 toward extended position 60-2. Thus, when shroud 56 is in retracted position 60-1 (see FIG. 7), shroud 56 is engaged with door jamb 26 under a force exerted by spring biasing mechanism 62. As the door panel 14 is moved away from closed position 36 (see FIG. 1) and toward open position 38 (see FIG. 2), spring biasing mechanism 62 moves shroud 56 toward extended position 60-2, as depicted in FIG. 8, to enclose latch hook 52 of latch assembly 42 to help prevent snagging of clothing and equipment, e.g., hospital garments, IV lines, etc., as personnel and/or equipment pass through the open door.

Referring to FIGS. 5-8, retractable latch hook shroud assembly 44 includes, in addition to shroud 56 and spring biasing mechanism 62, a base plate 64, a first post 66, and a second post 68.

Referring to FIGS. 6, 7, and 8, shroud 56 has an end wall 56-1 and a side wall 56-2 that extends away from end wall 56-1. Side wall 56-2 defines a latch hook recess 56-3. End wall 56-1 has a first hole 56-4, a second hole 56-5, and a latch assembly opening 56-6. First hole 56-4 of end wall 56-1 is configured to slidably receive first post 66 and second hole 56-5 of end wall 56-1 is configured to slidably receive second post 68. Referring to FIGS. 7 and 8, latch assembly opening 56-6 of shroud 56 is configured, e.g., as a slotted opening, to receive a portion of latch assembly 42.

Referring to FIG. 6, in the present embodiment, side wall 56-2 of shroud 56 is a continuous wall to form an enclosure that defines latch hook recess 56-3. The continuous wall may have a first radius portion 56-7 spaced from a second radius portion 56-8. Each of the first radius portion 56-7 and the second radius portion 56-8 may have an angular extent of approximately 180 degrees.

Referring to FIGS. 4 and 6, first post 66 extends from base plate 64 along movement axis 58-1 in a direction 59. Second post 68 extends from base plate 64 along movement axis 58-2 in direction 59. Second post 68 is spaced away from first post 66 in a direction orthogonal to direction 59. Direction 59 is parallel to each of movement axis 58-1 and movement axis 58-2.

Referring to FIGS. 6-8, first post 66 is a first elongate member having a first retention head 66-1 and a first connection end 66-2, e.g., a threaded hole. Referring also to FIG. 4, first post 66 is received through first hole 56-4 of end wall 56-1 of shroud 56, with first retention head 66-1 being positioned inside latch hook recess 56-3 when shroud 56 is in extended position 60-2. Referring again to FIGS. 6-8, first connection end 66-2 is connected to base plate 64 by a first mechanical fastener 72-1, e.g., a screw.

Second post 68 is a second elongate member having a second retention head 68-1 and a second connection end 68-2, e.g., a threaded hole. Referring also to FIG. 4, second post 68 is received through second hole 56-5 of end wall 56-1 of shroud 56, with second retention head 68-1 being positioned inside latch hook recess 56-3 (see FIG. 6) when shroud 56 is in extended position 60-2. Referring again to FIGS. 6-8, second connection end 68-2 is connected to base plate 64 by a second mechanical fastener 72-2, e.g., a screw.

Referring to FIGS. 4-6, spring biasing mechanism 62 is interposed between end wall 56-1 of shroud 56 and base plate 64. In the present embodiment, spring biasing mechanism 62 includes a first compression spring 62-1 and a second compression spring 62-2.

First compression spring 62-1 is received over first post 66. First compression spring 62-1 is interposed between base plate 64 and end wall 56-1 of shroud 56 when first post 66 is connected to base plate 64. End wall 56-1 of shroud 56 is interposed between first retention head 66-1 of first post 66 and first compression spring 62-1.

Second compression spring 62-2 is received over second post 68. Second compression spring 62-2 is interposed between base plate 64 and end wall 56-1 of shroud 56 when second post 68 is connected to base plate 64. End wall 56-1 of shroud 56 is interposed between second retention head 68-1 of second post 68 and second compression spring 62-2. Base plate 64 includes a first mounting plate 64-1 and a second mounting plate 64-2.

Referring to FIG. 6, first mounting plate 64-1 has a first aperture 70-1 for receiving first mechanical fastener 72-1 and a second aperture 70-2 for receiving second mechanical fastener 72-2. First post 66 is connected to first mounting plate 64-1 of base plate 64 by threadably engaging first mechanical fastener 72-1 with first connection end 66-2 of first post 66. Likewise, second post 68 is connected to first mounting plate 64-1 of base plate 64 by threadably engaging second mechanical fastener 72-2 with second connection end 68-2 of second post 68.

Referring to FIG. 7, second mounting plate 64-2 is configured for attachment to door panel 14 by mechanical fasteners 74-1, 74-2, e.g., screws. More particularly, retractable latch hook shroud assembly 44 is connected to door panel 14 by mechanical fasteners 74-1, 74-2. However, to do so, second mounting plate 64-2 is attached to door panel 14 by mechanical fasteners 74-1, 74-2, and then first mounting plate 64-1 is positioned adjacent to second mounting plate 64-2. Then, first mounting plate 64-1 is connected to second mounting plate 64-2 by mechanical fasteners 76-1, 76-2, e.g., screws. In this arrangement, second mounting plate 64-2 covers first mechanical fastener 72-1 and second mechanical fastener 72-2 respectively connected to first connection end 66-2 of first post 66 and second connection end 68-2 of second post 68.

After retractable latch hook shroud assembly 44 is connected to door panel 14, latch assembly 42 is inserted into latch assembly opening 56-6. Referring to FIGS. 4, 6, 7, and 8, latch housing 48 of latch assembly 42 has a pair of mounting tabs 48-1, 48-2 that are respectively connected to first retention head 66-1 and second retention head 68-1. More particularly, each of first retention head 66-1 and second retention head 68-1 has a threaded hole for receiving respective mechanical fasteners 78-1, 78-2, e.g., screws. Mechanical fasteners 78-1, 78-2 are respectively received through respective holes 48-3, 48-4 in the pair of mounting tabs 48-1, 48-2, and then are respectively threaded into first retention head 66-1 of first post 66 and second retention head 68-1 of second post 68.

Referring again to FIG. 7, when shroud 56 is in retracted position 60-1 (see FIG. 7), compression springs 62-1, 62-2 of spring biasing mechanism 62 are fully compressed, and shroud 56 is engaged with door jamb 26 under a force exerted by compression springs 62-1, 62-2. Thus, compression springs 62-1, 62-2 of spring biasing mechanism 62 continually bias shroud 56 toward extended position 60-2 (see also FIG. 8). As the door panel 14 is moved away from closed position 36 (see FIG. 1) and toward open position 38 (see FIG. 2), the decompression of compression springs 62-1, 62-2 of spring biasing mechanism 62 moves shroud 56 toward extended position 60-2, as depicted in FIG. 8, to enclose latch hook 52 of latch assembly 42 to help prevent snagging of clothing and equipment, e.g., hospital garments, IV lines, etc., as personnel and/or equipment pass through the open door.

As may be used herein, "substantially," "generally," "slightly" and other words of degree are relative modifiers intended to indicate permissible variation from the characteristic so modified. It is not intended to be limited to the absolute value or characteristic which it modifies but rather possessing more of the physical or functional characteristic than its opposite, and approaching or approximating such a physical or functional characteristic.

Terms such as "first", "second", "third", etc., may be used for identification purposes and, in an identification context, are not to be limiting as to quantity, order, or importance, unless otherwise specified.

For definitional purposes and as may be used herein, "connected" or "attached" includes physical or electrical, as appropriate, whether direct or indirect, affixed or adjustably mounted. Thus, unless specified, "connected" or "attached" is intended to embrace any operationally functional connection.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims. Therefore, it is to be understood that, within the scope of the appended claims, the invention may be practiced other than as specifically described above.

What is claimed is:

1. A retractable latch hook shroud assembly for snag prevention, the retractable latch hook shroud assembly comprising:

a base plate;

a first post that extends from the case plate in a first direction;

a second post that extends from the base plate in the first direction, the second post being spaced away from the first post in a direction orthogonal to the first direction;

a shroud having an end wall and a side wall that extends away from the end wall, the side wall defining a latch hook recess, the end wall having a first hole and a second hole, the first hole configured to slidably receive the first post and the second hole configured to slidably receive the second post;

a spring biasing mechanism interposed between the base plate and the end wall of the shroud, wherein the spring biasing mechanism comprises:

a first compression spring received over the first post and interposed between the base plate and the end wall of the shroud; and a second compression spring received over the second post and interposed between the base plate and the end wall of the shroud;

the spring biasing mechanism is configured to bias the shroud between an extended or retracted position; and wherein the retractable latch hook shroud assembly is configured such that an arrangement of the base plate, the first post, the second post, the spring biasing mechanism, and the shroud is configured for snag prevention when the shroud is an extended or retracted position.

2. The retractable latch hook shroud assembly for snag prevention of claim 1, wherein:

the first post is a first elongate member having a first retention head and a first connection end, the first connection end being connected to the base plate by a first mechanical fastener, the first retention head being positioned inside the latch hook recess with the end wall of the shroud being interposed between the first retention head and the first compression spring; and the second post is a second elongate member having a second retention head and a second connection end, the second connection end being connected to the base plate by a second mechanical fastener, the second retention head being positioned inside the latch hook recess with the end wall of the shroud being interposed between the second retention head and the second compression spring.

3. The retractable latch hook shroud assembly for snag prevention of claim 2, wherein the base plate includes:

a first mounting plate having a first aperture and a second aperture, the first aperture receiving the first mechanical fastener to connect the first post to the first mounting plate and the second aperture receiving the second mechanical fastener to connect the second post to the first mounting plate; and a second mounting plate positioned adjacent to the first mounting plate, the first mounting plate being connected to the second mounting plate, wherein the second mounting plate covers the first mechanical fastener and the second mechanical fastener.

4. The retractable latch hook shroud assembly for snag prevention of claim 1, wherein the shroud is in a retracted position the shroud is engaged with the door jamb under a force exerted by the spring biasing mechanism, and as the door panel is moved away from the closed position, the spring biasing mechanism moves the shroud toward the extended position to enclose the latch hook.

5. The retractable latch hook shroud assembly for snag prevention of claim 1, wherein the shroud includes an end wall and a side wall that extends away from the end wall, the side wall defining a latch hook recess to enclose the latch hook.

6. The retractable latch hook shroud assembly for snag prevention of claim 1, wherein the spring biasing mechanism is interposed between the end wall of the shroud and the base plate, and wherein the shroud includes an end wall and a side wall that extends away from the end wall, the side wall defining a latch hook recess to enclose the latch hook.

* * * * *